US005150273A

United States Patent [19]

Le Vantine

[11] Patent Number: 5,150,273

[45] Date of Patent: Sep. 22, 1992

[54] DEVICE FOR REMOVING DUST, LINT AND STATIC CHARGE FROM FILM AND PLASTIC SURFACES

[76] Inventor: Allan D. Le Vantine, 18225 Rancho St., Tarzana, Calif. 91356

[21] Appl. No.: 642,864

[22] Filed: Jan. 17, 1991

[51] Int. Cl.[5] ..... H05F 3/00

[52] U.S. Cl. ..... 361/221; 361/212; 361/214; 361/220

[58] Field of Search ..... 361/212, 213, 214, 220, 361/221

[56] References Cited

U.S. PATENT DOCUMENTS

| | | | |
|---|---|---|---|
| 2,023,321 | 12/1935 | Gutman | 361/220 |
| 3,636,408 | 1/1972 | Shoman | 361/220 |
| 3,816,799 | 6/1974 | Ott et al. | 361/212 |
| 4,805,068 | 2/1989 | Cumming et al. | 361/213 |
| 5,010,441 | 4/1991 | Fox et al. | 361/220 |

*Primary Examiner*—Jeffrey A. Gaffin

[57] ABSTRACT

A device for removing dust, lint and static charge from film and plastic surfaces. The device uses an improved design of rotating brushes incorporating electrically conductive fiber tufts. These electrically conductive fiber tufts remove the static charge while the rotating brush produces a sweeping action as well as an air convective action to remove the dust and conduct it away.

12 Claims, 2 Drawing Sheets

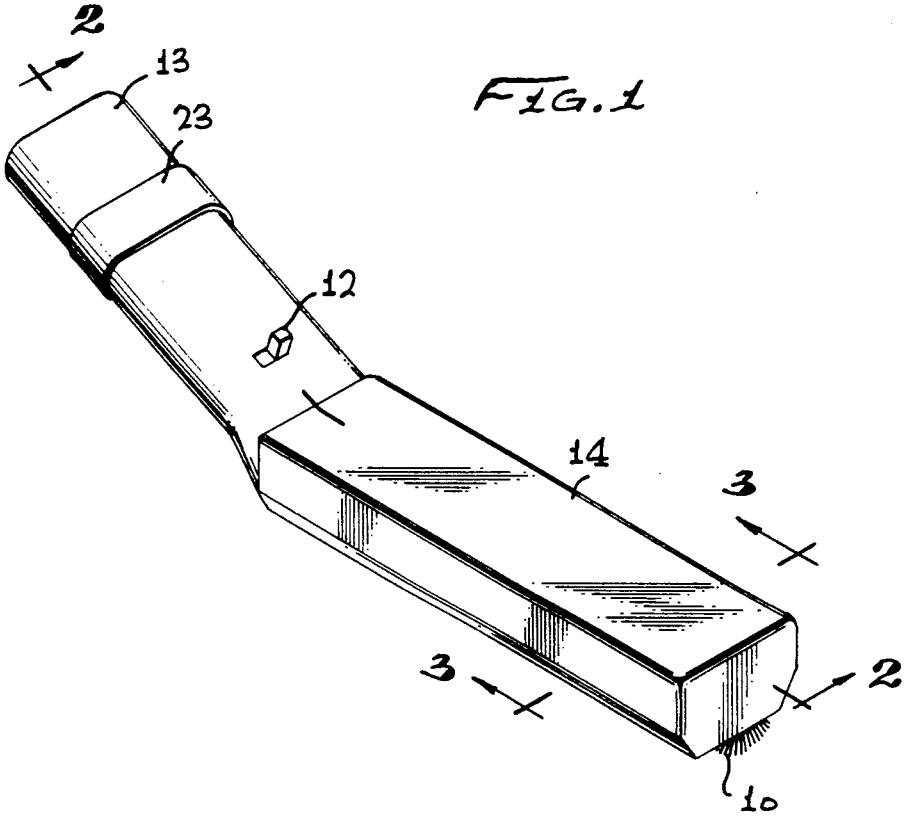
FIG. 1
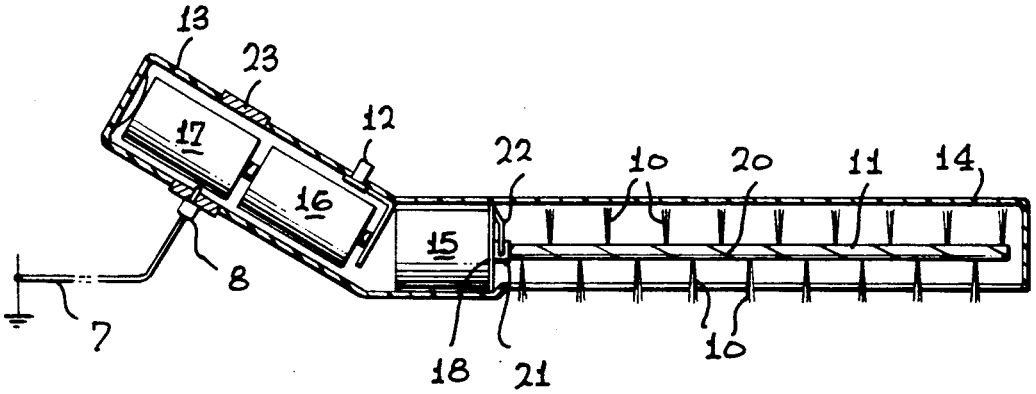
FIG. 2
FIG. 3
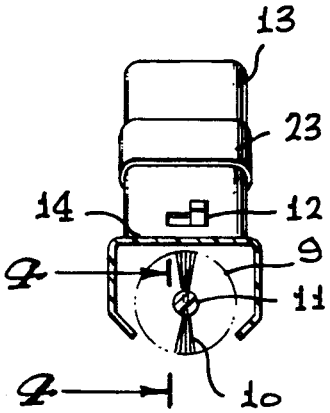
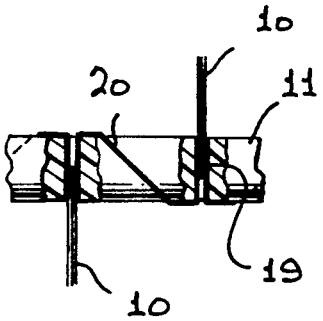
FIG. 4

DEVICE FOR REMOVING DUST, LINT AND STATIC CHARGE FROM FILM AND PLASTIC SURFACES

BACKGROUND OF THE INVENTION

1. Field of the invention

This invention relates to the removal of dust and lint and also static charge simultaneously from surfaces. In many industries the elimination of particulate materials such as dust and lint is of utmost importance. On plastic and non-conductive surfaces it is also necessary to remove any static charge at the same time as this static charge will bind these particulates to the surface by electrostatic forces as well as attract more such particulate matter to that surface.

An example of the importance of the above is found in the photo-processing industry When positive prints are made from photographic negatives, it is necessary to keep these negatives free from dust and lint so that the dust and lint are not imaged on the prints making them unacceptable. Other examples are industries that fabricate items from sheets of plastic, especially when the plastic is transparent. Picture framing using clear acrylics is a typical application where the dust and lint must be removed before the picture is installed. If the static charge is not removed, it is nearly impossible to remove the dust and lint. Laminating is another similar application. These are a few of the many places where dust, lint and static charge removal is essential.

2. Description of Prior Art

Over the years many methods have been devised to eliminate static charges from plastic surfaces. The primary method is by making the surrounding air electrically conductive, thus allowing the electric charges to be conducted away from the surface. These include such techniques as vaporizers and atomizers to humidify the air, radio-active material to ionize the air, and also high voltage emitters to ionize the air. Other methods which make direct contact with the surface have been used, such as metallic brushes, wipers, and liquids which are applied directly to the surface.

Static charge on non-conductive plastic surfaces usually develops as the result of contact with another plastic item. Such plastic surfaces, or items in contact, have an atomic valence attractive force that holds them together. This force is electric in nature and is of the variety that holds materials together. Separation of the items results in a rending of some of the negatively charged electrons from one of the surfaces by the stronger attractive force of the other, and the adherence of those electrons to that surface. Thus, the surface that has lost electrons is left with an electric charge to again attract negatively charged electrons, and has thereby acquired a positive charge. And, the surface which has gained the surplus of electrons has thereby acquired a negative charge.

This is a classic example of how static charges develop. However, static charges are known to develop in many ways and on surfaces and bodies that do not fit the above example. Static charges are transferable through conductive means such as in a Van de Graff generator, or by accumulation of charge on an electrically isolated body through friction means, such as an aircraft or a car by friction with the passing air. Charges can also be accumulated from direct contact with high voltage sources or by transmission from a surrounding ionized atmosphere.

Except in a vacuum, static charges tend to dissipate or leak off through the conductivity of the surrounding atmosphere. The more conductive the atmosphere, the faster the charge will leak off. In humid weather, the moisture in the air makes the air more conductive than in dry weather when there is little moisture in the air. Thus, we seldom encounter static charge on a humid day and frequently encounter it on a dry day.

Static charges are transferable. Static charge acquired by our clothing is transferred to our body or parts of our body. And, when we approach an object of different electrical potential (usually a ground potential), we experience an electric discharge as electrons arc from our finger to that object, or vice versa. Static charge can also be transferred from our bodies to tools or other items we contact. These tools in turn can impart the charge to a sensitive component causing damage.

Although an in depth discussion of the principles of the many techniques for removing static charge as well as eliminating dust, lint and other particulates can be pursued, let us limit the range of this discussion to the immediate scope as defined by the application of the devices that will emanate from the subject invention.

This invention is concerned with the removal of static charge, dust and lint by the use of a device that incorporates brush-like elements. Brushes have been used since the earliest of times for removing dust and lint. In more recent times they have been augmented by air ionizing means for eliminating static charge Lately the brushes themselves have been fabricated from electrically conductive filaments or by the use of electrically conductive wires woven into the brush to carry away the static charge.

Brushes, per se, have many drawbacks for applications where it is necessary to prevent any scratching of the plastic surface involved. Such is the case in the photo-processing industry. With the use of even fine brushes made from animal hair, extreme care had to be taken not to scratch the surface of the film. To this end, finer and finer filaments have been developed for use in brushes. These filaments are drawn from plastics such as nylon and acrylic. They-measure only two thousandths of an inch in diameter and have sufficient body and stiffness to be effective in removing the dust and lint from film without scratching it.

Removing the dust from the film does not get rid of the static charge Therefore, brushes have to be augmented with some static eliminating means. The means first used with brushes was a radioactive material of sufficiently low potency so as not to be a health hazard. The material was imbedded in the base of the brush. It was effective in removing the static charge as long as the potency of the radioactivity remained high and the brush was not passed over the film too rapidly. Generally these brushes did not remain effective very long as the radioactive material used, polonium 210, has a half-life of about four and one half months.

Later, specific film cleaners incorporated brushes for removing the dust from the film. A typical design is that presented by Cumming et al, U.S. Pat. No. 4,805,068. In this device, stationary brushes are positioned above and below the film, which contact the film, to remove the dust and lint as the film is pulled between them. Simultaneously, an electrical ionizing means is used to ionize the surrounding air to remove the static charge. Several other devices that incorporate similar designs have been noted on the market.

Metallic brushes have been used to eliminate static charge. One of the earliest designs is that of Gutman, U.S. Pat. No. 2,023,321. This design consists of a tinsel-like garland, formed of metallic elements, stretched across the sheet from which the static was to be removed. Of course, if the metal elements touched a photographic film, they would damage the film. Hence, such a device was never used in photo-processing. Nishikawa, U.S. Pat. No. 4,307,432 uses a brush device made of fine wires (although he doesn't say how fine) to eliminate static charge. However, he positions the brush so that it never contacts the film. This prevents scratching the film, but it also limits the ability to remove static charge. The ability of the charge on the film to discharge to the metal brush wires is relative to the charge on the film and the distance of the wire from the brush. At a distance of only a few thousandths of an inch from the film, the remaining charge that would not be discharged from the film would still be several hundreds or even thousand volts. (My experimental results disagree considerably with Nishikawa's.)

Another brush device presented by Troia, U.S. Pat. No. 3,470,567. Troia uses rotating brushes to clean the film. However, his brushes are spaced from the film so that they make only light intermittent contact with the film as they rotate. The thrust of his invention is to clean the film and still keep the brushes from scratching the film by limiting their contact.

The deficiency of the Nishikawa and Troia technology is that they are concerned with, and treat, two separate aspects that my invention embodies. One removes the static charge and the other removes the dust. It might seem that combining the two would be all that was necessary to remove both. This may be true, but these techniques both have severe limitations and complexities of implementation that are not acceptable in todays present advancements in the state-of-the-art in photo-processing and other related field.

SUMMARY OF THE INVENTION

Accordingly, it is an object of this invention to provide an improved device for the simultaneous elimination of static charge, dust and lint from plane surfaces.

It is another objective to provide an improved device for eliminating static charge by the use of electrically conductive rotating brushes.

It is an object of this invention to provide an improved device for removing dust and lint by the use of rotating brushes that provide a sweeping action as well as an air convection action.

It is also an objective of this invention to provide an improved technique for the design of rotating brushes to simultaneously remove static charge, dust and lint from plane surfaces.

The above and other objectives of the present invention are achieved according to the following aspects thereof.

The primary elements of my invention are termed rotors. Rotors are rods that support tufts of hair-like fibers. The fibers are electrically conductive. The fibers are of a sufficiently small diameter so that they can be easily bent and, therefore, will not apply significant pressure that could visibly score or scratch a plane surface when brought into contact with that surface, and having a sufficiently high modulus of elasticity so that they will not deform and return to their original shape when removed from that surface. The rotors are supported by bearing means so that they are free to rotate about their longitudinal axes. A drive means causes the rotors to rotate about their axes. An electrical conduction means, which maintains rotational electrical continuity, connects the conductive fibers on the rotors to a stationary terminal means providing a connection means to apply an electrical ground potential to the rotating fiber tufts.

A drive means for rotating the rotors at an angular velocity sufficient to sweep dust and lint from a surface and also to produce an air flow along that surface to convect the removed dust and lint away from that surface.

A support means provides for retaining the elements of the invention as an integral unit so that it can be handled or mounted for functional applications. Such application being, but not limited to, bringing the device into contact with a plane surface for the removal of static charge, dust and lint.

Although many embodiments of the invention can be visualized, two are herein described as being typical applications thereof.

In the first embodiment, a single rotor is used. The rotor has a central rod one quarter of an inch in diameter and about six inches long with tufts extending from diametrically opposite sides of the rotor to a diameter of about one inch. The rotor is mounted to the shaft of a small electric motor. The motor is retained in a handle. The handle also contains a battery which serves as a power source for the electric motor. A hood means extends from the handle over the upper part of the rotor. An electric switch in the handle turns the motor on and also determines the direction of rotation of the motor.

In use, the motor is turned on, so that the rotor rotates. The rotating rotor is brought into contact with the surface to be cleaned, such that the fiber tufts of the rotor are significantly deflected by contact with that surface. The rotors are set to rotate in the direction to sweep the dust and lint ahead of the direction of travel of the device. As the conductive fibers contact the surface, they sweep away the dust and lint and also conduct the static charge from the surface, leaving the surface static free and dust free.

The dust is always swept ahead of the unit so that it will not be redeposited on the surface. Also, the rotors are selfcleaning as the dust and lint are always ejected tangentially from the rotating tufts as the result of the centrifugal force generated by the rotation.

A mathematical relationship has been derived which describes approximately the pressure induced by the impact of the fibers on the surface being treated. This relationship is expressed in the following equation which is derived from the physical laws defining deflection and centrifugal force.

$$P = \frac{\pi}{16}\left[\frac{E\,D^2}{4\,l^2} + \frac{d\,l^2\,\omega^2}{g}\right]$$

where:

P = Pressure induced by fibers
E = Modulus of elasticity
D = Diameter of fiber
l = Length of fiber
d = Density of fiber material $\omega$ = Angular velocity of rotating rotor (brush)
$\pi$ = The natural ratio
g = Acceleration of earth gravity Using this equation, it has been determined that surface pressures greater than approximately 0.55 psi will scratch photographic film. Therefore, fibers with suitable properties must be used and angular velocities must be selected to prevent scratching the surface.

In this embodiment the fiber tufts are comprised of metallic coated fibers measuring one-quarter of a thousandth of an inch in diameter. Two thousand fibers are combined in each individual tuft. The tufts are spaced one-quarter of an inch apart, projecting alternately from either side of the rotor. The fibers have a high electrical conductivity so that they will instantly conduct away any static charge as they contact the surface. In addition, the fibers have a modulous of elasticity (Youngs modulus) of 30,000,000 PSI so that even with their small diameter, they have ample spring force to sweep away the dust and lint and return to their original shape once they disengage from the surface. The rate of rotation of the rotors is on the order of 3,000 RPM.

In this embodiment there is an electrical continuity between the rotors and the handle. The handle is made electrically conductive so that there is a conduction path from the tufts to the person holding the device. By this means the individual using the device provides a means of dissipating any static charge. If the static charge is excessive, an additional electrical ground connection can be affixed.

The second embodiment is envisioned as a device for cleaning both sides of a strip of film simultaneously. It utilizes two counter-rotating rotors. The rotors are mounted axially and spaced apart. The same type of rotors as described in the first embodiment, each having an overall diameter of one inch, are used. The separation of the rotors is approximately three-quarters of an inch apart, leaving one-quarter of an inch overlap of the tufts of the rotors. To prevent the tufts from intersecting each other, the rotors are synchronized by two meshing spur gears affixed to the rotors. These gears cause the rotors to turn so that the tufts on opposite rotors always project into the spaces on the opposite rotor that do not support tufts. Thus, the tufts from opposite rotors will not intersect each other.

The rotors are rotated by an electric motor integrally connected with one of the rotor rods. The motor is operated from a source of power derived from a plug-in adapter that reduces the line voltage and rectifies it to three volts D.C. A low voltage cord also serves as a ground connection via the plug-in adapter.

The device is housed in a case means which completely supports all the components of the device so that it can operate as a stand alone device. The case means supports the rotors such that one rotor is located directly above the other. The case means also completely encloses the rotors except for a narrow opening to allow strip film to pass through the space between the rotors. To operate the device the power is turned on and the direction of rotation selected. The film is inserted into one side of the device and removed from the other. The rotation of the rotors is always set so that the dust that is removed is always swept back away from the direction in which the film is traveling. Due to the velocity of rotation, the rotors create a convective air current that aids in dispersing the dust and lint away from the cleaned part of the film.

It should be recognized that the above embodiments are only two that have been constructed and tested. It should be apparent that there are many more embodiments that can be envisioned. However, these two do provide a means for an adequate description of the invention.

BRIEF DESCRIPTION OF THE DRAWINGS

The above embodiments of the invention may be more fully understood from the following detailed descriptions taken together with the accompanying drawings wherein similar reference characters refer to similar elements throughout and in which:

FIG. 1 is a perspective view of one embodiment of the invention.

FIG. 2 is a sectional view along lines 2—2 of FIG. 1.

FIG. 3 is a sectional view along lines 3—3 of FIG.1.

FIG. 4 is an enlargement of a section through Rotor Shaft 11.

DESCRIPTION OF PREFERRED EMBODIMENTS AND APPLICATIONS

Figure 5:
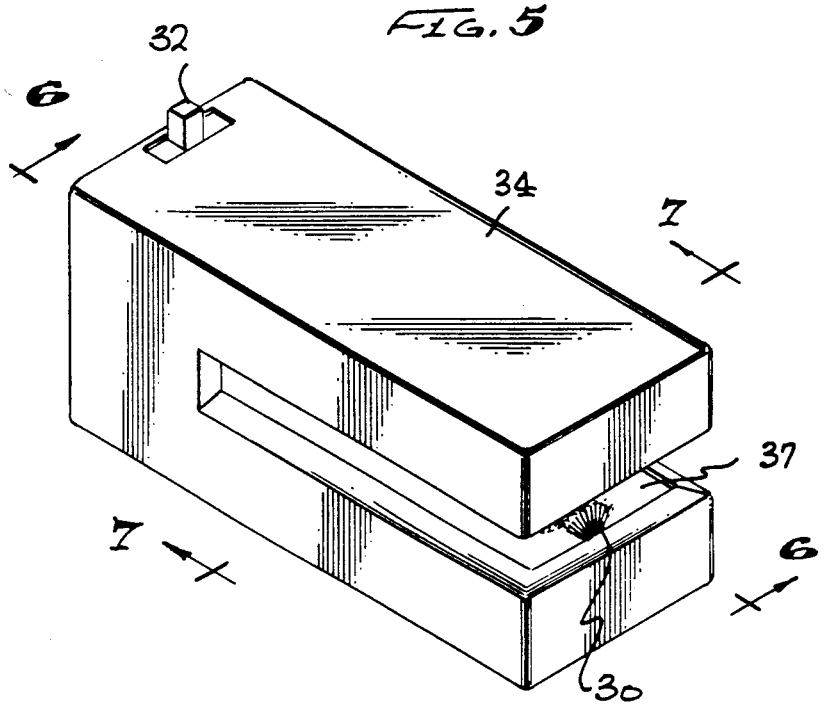
FIG. 5 is a perspective view of a second embodiment of the invention.
Figure 6:
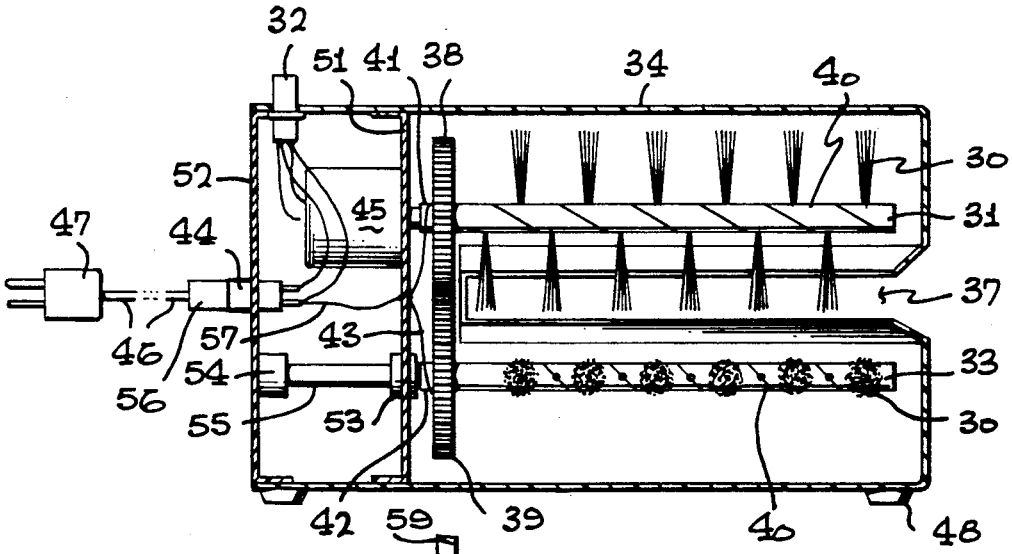
FIG. 6 is a sectional view along lines 6—6 of FIG. 5.

The embodiments of the invention are envisioned but not limited to those described. It should be recognized that other designs can be used to accomplish the unique principles set forth here. Different techniques for fabricating or shaping the rotors could be used, and different methods for rotating them are conceivable and can be envisioned. Moreover, the invention is not limited to the applications described.

Referring to the figures, FIGS. 1, 2 and 3 illustrate the first preferred embodiment of the invention which would be used for cleaning dust and lint and removing static charge from a single plane surface. It is comprised of a case means 14 which has a handle means 13 continuous with it and extending at a slight angle upward from one end. In this version, the case means and handle means are molded from one piece of thermosetting plastic. Present on the top of the handle is a three position slide switch 12. The center position of the slide switch is the off position, and each of the two side positions control the rotation direction of the rotors. Surrounding the handle is a metallic band 23 which serves as a ground contact through the individual who is holding the device. Projecting from the lower portion of the case are the fiber tufts 10 of the rotor.

A sectional view along lines 2—2 of FIG. 1, FIG. 2, shows the internal components of the embodiment. A metal plate means 18 mounted rigidly with the case supports the motor means 15. Projecting from the motor means is rotor shaft 11 which is affixed to the rotating shaft of the motor means. The rotor shaft supports conductive fiber tufts 10 spaced about onequarter of an inch apart and projecting from the shaft in alternating directions as shown in the figure. Electrical wire 20 interconnects with each of the fiber tufts and terminates in slip-ring 21 mounted on the motor end of the shaft. Slipping wiper 22 connects metal mounting plate means 18 with the slip-ring and hence the fiber tufts via electrical wire 21. The metal plate is electrically connected (not shown) to metallic band 23 so as to provide electrical continuity between the fiber tufts and the hand of the person holding the device. For optional use, to dissipate high electrical potentials, an earth ground wire 7 can be connected to metallic band 23 by means of terminal connection 8.

Batteries 17 and 18 are located in the handle. Electrical connection is provided to the motor means 15 through the switch 12 (not shown) to energize and activate the motor means. For this embodiment motor means is a low voltage D.C. motor that will rotate in one direction when the positive and negative connections from the batteries are connected to the motor terminals and to rotate in the opposite direction when the battery connections are reversed. Switch 12 is connected to provide this reversal when moved from one side to the other. In addition switch 12 has a center OFF position.

A cross sectional view along line 3—3 as shown in FIG. 3 shows the rotor shaft 11 with the conductive fiber tufts 10 extending. Also shown by the broken line is the arc that the tufts sweep through when they rotate. An enlarged section of rotor shaft 11 along line 4—4 is shown in FIG. 4 wherein the construction of the fiber tufts can be seen. Holes 19 drilled through shaft 11 serve as a receptacle to mount the tufts 10 which are held in place by electrical wire 20. Electrical wire being held in intimate contact with the tufts provides the necessary contact.

In operation, the device is held in the hand. It is held above the plastic sheet to be cleaned. The device is turned on by sliding switch 12 in the direction that the device is to be passed over the surface of the sheet. If the device is to pass to the right, the switch will make the connections between the motor and the batteries such that the rotor turns in a counterclockwise direction. Thus, as the device is lowered and comes into contact with the surface and moved in a direction toward the right, the rotor tufts will sweep the dust and lint ahead of it. If the device is to be passed over the sheet in a direction toward the left, the switch would be slid to the left and the rotor would turn in a clockwise direction sweeping the dust and lint to the left.

The electrically conductive fiber tufts provide a means for any electrical charge on the plastic surface to be conducted from that surface as the tufts come in contact with that surface. Thus, as the rotating tufts contact the surface and sweep over it, they remove any electric charge as well as the dust and lint that may be present. An additional aid in removing the dust and lint is the convection effects resulting from the rotating tufts. This rotary motion, at around 3,000 RPM, produces sufficient convection currents to blow most loose dust and lint away. The remaining dust and lint or other particulate material is removed by the physical contact of the tufts.

The second embodiment of the invention is shown in FIG. 5. This configuration is designed for cleaning photographic film. It is comprised of a case means 34 which has a horizontal opening 37 of sufficient width to allow film to be easily inserted without contacting the edges of the opening. Accessible within the horizontal opening are electrically conductive fiber tufts that contact the film when it is inserted. On the top of the case means is an electrical switch 32 that turns the device on and off and also controls the direction of rotation of the internal elements.

A sectional view of the device along line 6—6 of FIG. 4, FIG. 5, shows the internal components of this embodiment. Within the case means is mounting plate 51 which serves as a mounting and supports motor 45 and bearing 53. Closure plate 52 seals the rear of the unit and serves as a mounting structure for rear bearing 54, low voltage receptacle 44 and switch 32. Shaft 55 is mounted in bearings 53 and 54 and extends forward through mounting plate 51 and is inserted and affixed to upper rotor shaft 33. Similarly the shaft from motor 45 extends through plate 51 and is inserted and affixed to lower rotor shaft 31. Both rotor shafts support conductive fiber tufts 30 and are rendered electrically continuous with a ground connection via wire 40, slip-rings 41 for the upper rotor and 42 for the lower rotor, and slip-ring wiper 43 which is attached to mounting plate 51, and electrically grounded via wire 57 to receptacle 44.

Figure 7:
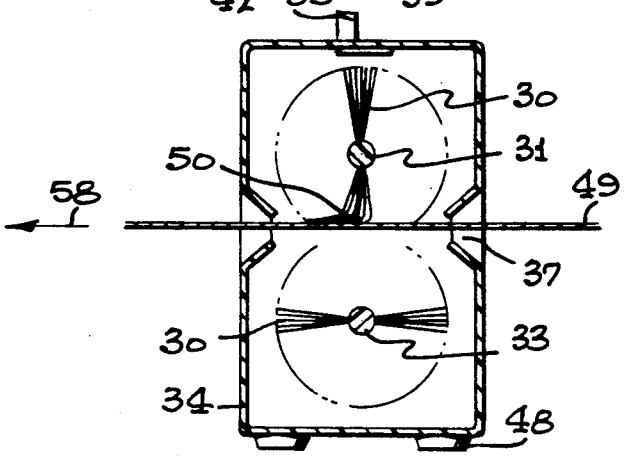
FIG. 7 is a sectional view along lines 7—7 of FIG. 5.

Affixed to the mounting end of the rotor shafts 31 and 33 are gears 38 and 39 which mesh so that rotors 31 and 33 turn in opposite directions. Gears 38 and 39 also synchronize the two shafts such that the fiber tufts of one shaft will never contact the fiber tufts of the other. This is shown in FIG. 7 where the upper set of fiber tufts is in a vertical position and the lower set is in a horizontal position The gears maintain this general relationship of the orientation of the two sets of tufts at all times.

Motor 45 is a DC type that can rotate in either direction depending on the direction of the electric current through it. Power is supplied to the device from low voltage adapter 47 which converts the AC line voltage to three volts DC. The DC voltage is conducted through low voltage cord 46 to low voltage plug 56. Plug 56 interconnects with receptacle 44 to provide power to the unit. In adapter 47 one side of the DC line is connected to ground to provide a ground connection which becomes electrically continuous with the fiber tufts.

Internally within the unit switch 32 is electrically connected to the DC power from receptacle 44. Switch 32 is further connected to motor 45. By its switch position switch 32 will alter the direction of the electrical current through the motor 45 thereby determining which direction the motor will rotate. Switch 32 also has a center OFF position.

Externally this embodiment supports four rubber mounting feet 48 adhesively fastened to its lower surface. These provide a stable mounting means so that the device will not slide on a mounting surface.

FIG. 7 shows a sectional view along line 7—7 o FIG. 5 with a length of photographic film 49 inserted through the open space in the case means. In this case, the film is being moved in a direction shown by arrow 58. Switch position 59 indicates the direction of travel of film 49 through electrical connections that have been made so that upper rotor shaft 31 turns in a counterclockwise direction and lower rotor shaft 33 turns in a clockwise direction. Thus, the rotation of the fiber tufts opposes the direction of travel of the film, sweeping the dust and lint in the opposite direction and keeping the dust and lint from resettling on the emerging film.

Fiber tuft 30 deflects as it contacts film 47 as shown by position 50. This scrubbing action removes any particles adhering to the film and also makes a positive electrical contact with the film to conduct away any electrical charge that may be on either surface of the film.

While the principles of the invention are thus disclosed and two embodiments and two applications are described in detail, it is not intended that the invention be limited by such. It should be recognized that many modifications will occur to those skilled in the art which underlies the scope of this invention and that the invention cover such modifications and be limited only by the appended claims.

What is claimed is:

1. A dust, lint and static charge removing device comprising:

a housing means for supporting the components of the device and having a handle means for holding the device, wherein the handle means supports a first electrical conduction means on its external surface, said first electrical conduction means being positioned such that it makes contact with the hand of the person holding the device, said first electrical conduction means having electrical continuity with the fiber tufts of the rotor means, a rotatable shaft means mounted on bearing means within the housing means, said shaft means supporting a plurality of spaced apart electrically conductive fiber tufts, said fiber tufts projecting radially from said shaft means, second electrical conduction means which provides electrical continuity between the fiber tufts of said shaft means and to a terminal connection on the housing means, a third electrical conduction means from the terminal connection the housing means to an earth ground, a motor means for rotating the shaft means, a power source means for providing power for the motor means, a switch means for selecting the direction of rotation of the motor means, a switch means for turning the motor means on and off.

2. The device of claim 1 wherein the motor means is an electric motor,

3. The device of claim 1 wherein the housing means contains the power source for the motor means, said power source being one or more electrical storage batteries.

4. The device of claim 1 wherein the power source for the motor means is a low voltage adapter connected to the motor means electric power cord.

5. The device of claim 1 wherein pressure induced on plastic film or sheet inserted into the device, as determined by the equation $$P = \frac{\pi}{16}\left[\frac{E\,D^2}{4\,l^2} + \frac{d\,l^2\,\omega^2}{g}\right]$$

where: P =the pressure induced by the fibers of the tufts, E =the modulus of elasticity of the fibers, D=the diameter of the fibers, 1 =the length of the fibers, d=the density of the fiber material, $\omega$=the angular velocity of the rotatable shaft means, g =the earths gravitational acceleration and $\pi$=the natural circle to diameter ration, is less than 0.55 pounds per square inch.

6. A dust, lint and static charge removing device comprising:

a housing means for enclosing and supporting the components of the device, said housing means having a slot-like opening at one end of sufficient width and depth to allow plastic film or sheet to be inserted, said housing means having internal means for mounting the components of the device, said housing means having an access means for installing and servicing the components and serving as a closure panel of the device, the external surface of the housing means having a provision for supporting a switch means and electrical connection means as may be required, and also presenting means for mounting said device, a plurality of two or more rotatable shaft means mounted on bearing means within the housing means said plurality of shaft means each supporting a plurality of spaced apart electrically conductive fiber tufts, said fiber tufts projecting radially from said shaft means, said shaft means spaced apart such that the arc swept by the tips of the fiber tufts of one shaft means will overlap the arc swept by the tips of the tufts of an adjacent shaft means, said positioning of the fiber tufts on the shaft means such that tufts on adjacent shaft means can intermesh without intersecting tufts on adjacent means, a first electrical conduction means which provides electrical continuity between the fiber tufts of each shaft means and to a terminal connection on the housing means, a second electrical conduction means from the terminal connection on the housing means to an earth ground, a motor means or plurality of motor means for rotating the plurality of shaft means, a power source means for providing power for the motor means or plurality of motor means, a switch means for selecting the direction of rotation of the motor means or plurality of motor means either individually or for all, a switch means for turning the motor means, or plurality of motor means, on and off.

7. The device of claim 6 wherein the motor means or plurality of motor means are electric motors.

8. The device of claim 6 wherein the plurality of shaft means comprises two shafts each rotating in a direction opposite the other.

9. The device of claim 8 wherein a synchronization means is employed for controlling the orientation of each shaft relative to the other shaft means such that the fiber tufts mounted on each shaft will not intersect or contact the fiber tufts of the other shaft.

10. The device of claim 6 wherein the power source is a low voltage adapter connected to the motor means or plurality of motor means by an electric power cord.

11. The device of claim 6 wherein the power source for the motor means or plurality of motor means is one or more electrical storage batteries.

12. The device of claim 6 wherein the pressure induced on the plastic film or sheet inserted into the device, as determined by the equation $$P = \frac{\pi}{16}\left[\frac{E\,D^2}{4\,l^2} + \frac{d\,l^2\,\omega^2}{g}\right]$$

where: P=the pressure induced by the fibers of the tufts, E=the modulus of elasticity of the fibers, D=the diameter of the fibers, 1 =the length of the fibers, d=the density of the fiber material, $\omega$=the angular velocity of the rotatable shaft means, g=the earths gravitational acceleration and $\pi$=the natural circle to diameter ratio, ie less than 0.55 pounds per square inch.

* * * * *